US005996493A

United States Patent [19]

Okumura et al.

[11] Patent Number: 5,996,493

[45] Date of Patent: Dec. 7, 1999

[54] STAMP UNIT PROTECTION ELEMENT

[75] Inventors: Takashi Okumura, Nagoya; Mitsunobu Suda, Ichinomiya; Keiji Seo; Hiroshi Takami, both of Nagoya; Minoru Yamamoto, Yokkaichi; Koji Sugiyama, Nagoya, all of Japan

[73] Assignee: Brother Kogyo Kabushiki Kaisha, Nagoya, Japan

[21] Appl. No.: 09/264,572

[22] Filed: Mar. 8, 1999

[30] Foreign Application Priority Data

| | | | |
|---|---|---|---|
| Mar. 9, 1998 | [JP] | Japan | 10-056727 |
| Sep. 17, 1998 | [JP] | Japan | 10-263023 |
| Sep. 17, 1998 | [JP] | Japan | 10-263024 |

[51] Int. Cl.[6] ..... B41K 1/42

[52] U.S. Cl. ..... 101/333; 101/108; 101/416.1

[58] Field of Search ..... 101/327, 233, 101/334, 101, 103, 104, 108, 416.1

[56] References Cited

U.S. PATENT DOCUMENTS

| | | | |
|---|---|---|---|
| 5,483,880 | 1/1996 | Seo et al. | 101/125 |
| 5,595,112 | 1/1997 | Seo | 101/125 |
| 5,694,844 | 12/1997 | Taira | 101/125 |

FOREIGN PATENT DOCUMENTS 0 798 114 A2 10/1997 European Pat. Off. .

*Primary Examiner*—Ren Yan
*Assistant Examiner*—Dave A. Ghatt
*Attorney, Agent, or Firm*—Oliff & Berridge, PLC

[57] ABSTRACT

A stamp unit has a transparent film which protects a stamp surface of the stamp material at the time of transportation of the stamp unit, during storage until a user starts to produce a stamp after purchasing the stamp unit, and during production of the stamp plate. The transparent film is thermally adhered on the lower edge of the holder member and is capable of protecting the surface of the stamp material until the start of the stamp printing. The transparent film is capable of easily and economically adhering to the stamp material without adhering to a thermal adhesion jig.

20 Claims, 15 Drawing Sheets

STAMP UNIT PROTECTION ELEMENT

This application is related to Ser. No. 09/240,877, filed Feb. 1, 1999.

BACKGROUND OF THE INVENTION

1. Field of the Invention

The invention relates to a stamp unit having a holder member which is slidably disposed, in an axial, or up and down, direction within a skirt member and holds a stamp surface forming material at a lower end portion. A grip member is disposed on an upper portion of the holder member and moves the holder member downwardly. More specifically, this invention is a stamp unit having a transparent film which protects a stamp surface during transportation of the stamp unit, a period until a user starts to produce an original stamp plate using the stamp surface forming material after purchasing the stamp unit, and during production of the stamp plate. The transparent film is thermally adhered to a lower edge of the holder member, and is capable of protecting the stamp surface of the stamp material until the starting of stamp printing.

2. Description of the Related Art

Heretofore, several types of stamp units have been proposed. To focus on the method for producing a stamp plate used on such a stamp unit, stamp units will be classified into the following two groups. A type of stamp unit, for example, is disclosed in U.S. Pat. No. 5,483,880. Such a type of stamp unit has a grip portion, a stamp portion and a skirt member, the grip portion and the stamp portion are connected so that the stamp portion can be moved in an axial direction within the skirt member. A stamp material is installed covering the lower surface of an ink impregnated body. The stamp material comprises a thermal porous sheet having a porous substrate adhered to a thermoplastic film.

To produce a stamp plate capable of printing characters and images from the stamp material using such a stamp unit, the stamp unit is mounted on a stamp producing apparatus having a thermal head. The thermal porous sheet of the stamp material is perforated according to the desired characters by controlled heating of the thermal head, whereby the stamp plate is produced. After that, when printing characters and/or the image, if the grip portion is pressed downward under the condition that the stamp unit is disposed on a desired position of the printing sheet, ink impregnated by the ink impregnated body attaches to the printing sheet through the holes formed on the thermal porous sheet. Thereby, characters and/or the image can be printed.

A second type of stamp unit is described in European unexamined Patent-Application Publication No. EP 0 798 114, having a grip portion and a holder member. The holder member is connected to the grip portion. A stamp surface forming material is provided on the lower surface of the holder member.

The stamp surface forming material of the stamp unit comprises a porous resin layer. The porous resin layer is melted and solidified by being heated.

To produce this stamp surface forming material, a roll-shaped transparent film is transported within a stamp producing apparatus. As the film is transported, character and image data are printed thereon using a thermal head and an ink transfer ribbon to produce a positive copy of the desired stamp image. Then, the positive copy and the stamp surface forming material are set so as to oppose each other with a transparent acrylic plate provided therebetween. As the acrylic plate has higher melting point than that of the stamp surface forming material, when a light emitting member, such as a xenon tube or a laser light source, emits light under this condition, the lower portion of the stamp surface forming material is illuminated through the positive copy. Only the part of the lower portion of the stamp surface forming material, which is illuminated through the transparent portion of the positive copy, is melted and, as a result, solidified and sealed. The lower portion of the stamp surface forming material, which is neither melted nor solidified, remains as it is and is in the form of characters and the like of the desired image. Thereby, the stamp plate is produced on the stamp surface forming material. When the stamp unit is properly positioned, and the grip portion is pressed downward, the ink impregnated in the stamp surface forming material is exuded from the non melted-solidified portion and adheres to the printing sheet. Thus, the desired characters and/or image are printed.

In the second type of stamp unit, the stamp plate is directly produced on the stamp surface of the stamp surface forming material. Therefore, it is desirable to protect the stamp surface at the time of transportation of the stamp unit, during storage until a user starts to produce the stamp plate, and during production of the stamp plate. One way to protect the stamp surface of the stamp surface forming material would be to fix a protection film on the holder member. As one method to fix the protection film thereon, it is possible to provide an adhesive layer on the holder member and to adhere the film on the holder member. However, in such the case, there is a possibility that the adhesive layer has an adverse affect on the stamp surface of the stamp surface forming material. As a result, there is a problem that one cannot obtain an accurate stamp plate according to the positive copy. Therefore, up to the current time, the protection film is closely contacted with the stamp surface of the stamp surface forming material. However, the protection film is easily peeled off, because it is only closely contacted and it is not enough to protect the stamp surface of the stamp surface forming material.

Further, as a method to fit the stamp surface forming material with the holder member, it is common that the outer periphery of the stamp surface forming material is thermally adhered to the holder member using a thermal adhesion jig. However, the stamp surface forming material and the holder member include resin materials, so there is a problem that the resin materials adhere to the thermal adhesion jig at the time of thermal adhesion. In order to prevent adhesion to the thermal adhesion jig, measures are taken to specially treat the thermal adhesion jig, or to conduct the thermal adhesion with the intervening heat-resistant film between the stamp surface forming material and the holding member. However, to specially treat the thermal adhesion jig causes a jump in the stamp unit price, and to conduct the thermal adhesion with the intervening heat-resistant film between the stamp surface forming material and the holding member is complicated work, and prevents a smooth thermal adhesion.

SUMMARY OF THE INVENTION

Therefore, an object of the invention is to solve the problems described above, and to provide a stamp unit having a transparent film which protects a stamp surface of a stamp surface forming material during transportation of the stamp unit, a storage period until a user starts to produce a stamp plate, and during the production of the stamp plate which is thermally adhered on a lower edge of a holder member. The transparent film is capable of protecting the stamp surface of the stamp surface forming material until the start of stamp printing. Another object is to provide a stamp unit having a transparent film, by which the stamp surface forming material can be easily and economically adhered to the holder member without the melted resin material adhering to the thermal adhesion jig.

In order to accomplish the above objects of the invention, the invention provides a stamp unit comprising a skirt member, a holder member, a grip member and a transparent film. The holder member is slidably disposed within the skirt member for movement in an axial direction. The holder member holds a stamp surface forming material at a lower end portion thereof. The grip member is disposed above the holder member, and moves the holder member downwardly. The transparent film covers a stamp surface of the stamp surface forming material, wherein an outer periphery of the stamp surface forming material is thermally adhered to the holder member under the condition that a lower edge of the holder member is uncovered, and the transparent film is thermally adhered to the lower edge of the holder member.

In this stamp unit, the transparent film is thermally adhered to the lower edge of the holder member in order to cover the stamp surface of the stamp surface forming material. Therefore, it is possible to protect the stamp surface of the stamp surface forming material during transportation of the stamp unit, during storage until a user starts to produce a stamp plate after purchase of the stamp unit, and during stamp plate production, without using any adhesive agent, and to protect the surface of the stamp surface forming material until the start of stamp printing. Further, the transparent film is thermally adhered with the holder member simultaneously. Therefore, it can be easily and economically adhered to the stamp surface forming material without the melted resin material sticking to the thermal adhesion jig.

In the stamp unit, it is desirable that the holder member, the stamp surface forming material and the transparent film include resin material, a melting temperature of the resin material included in the transparent film being higher than the melting temperature of the resin material included in the holder member and the stamp surface forming material. Therefore, the transparent film is not adhered to the lower edge of the holder member firmly by the high melting temperature thereof, and the transparent film can be peeled from the holder member easily.

In the stamp unit, it is desirable that the stamp surface forming material and the transparent film are thermally adhered simultaneously by a thermal adhesion jig. Therefore, they can be adhered with only one adhesion operation. At this time, if the melting temperature of the resin material included in the holder member and the stamp surface forming material are nearly same, they can be adhered firmly. On the other hand, as the melting temperature of the resin material included in the transparent film is higher than that of the holder member and the stamp surface forming material, it is not firmly adhered to the holder member.

Further, in the stamp unit, it is desirable that the transparent film be made of a transparent resin film. A light emitting member, such as a xenon tube or a laser light source, emits light, so that the stamp surface forming material is selectively melted, solidified and sealed in accordance with the images printed on the positive copy, whereby a stamp plate is produced. In the process for producing the stamp plate, the stamp surface of the stamp surface forming material can be protected. The transparent film is arranged to protect the stamp surface forming material, so that the transparent film acts as an insulation wall at the time of producing the stamp plate, and a part of the porous resin layer which should not be melted, that is the desired stamp image will be formed thereon, is prevented from melting, and good stamp quality can be obtained.

Further, in the stamp unit, it is desirable that a grip portion be formed on an outer periphery of the thermal adhesion portion of the transparent film. The transparent film is held by the grip portion, and is peeled from the lower edge of the holder member at the time of stamp printing. By using the grip portion, the transparent film can be peeled easily from the holder member at the start of stamp printing.

Further, in the stamp unit, it is desirable that the transparent film be coated with a releasing material on a surface facing, or opposing, the stamp surface forming material. In such a case, it can prevent the porous resin layer sticking to the transparent film, and being peeled from the stamp surface forming material, when the transparent film is released from the stamp surface forming material after producing the stamp plate. The releasing material is to reduce the adhesive strength between the stamp surface forming material and the transparent film and to decrease the force necessary to peel the transparent film from the stamp surface forming material.

Further, it is more desirable that the releasing material be coated on both sides of the transparent film. If so, in addition to the effect mentioned above, it can prevent the resin material of the transparent film from sticking to the thermal adhesion jig and the ink of the positive copy sticking to the transparent film. Further, it is not necessary that the releasing material coated on the surface not facing to the stamp surface forming material be the same material as that of coated on the surface facing to the stamp surface forming material. If the same releasing material is used, it is desirable to use a material which decreases the adhesive strength both between the transparent film and the ink of the positive copy and between the transparent film and the thermal adhesion jig, and reduces the force necessary to peel the transparent film.

Further, it is more desirable the releasing material be silicone resin as to obtain good effect with low cost.

Further, it is desirable that the transparent film comprise two layers. Thereby, the insulating effect of the transparent film can be strengthened, and good stamp quality can be obtained. Further, if the releasing material is coated on both sides of the transparent film, the insulating effect can be strengthened, and the further improvement in the quality can be obtained.

As mentioned above, according to the invention, it will be possible to provide a stamp unit having a transparent film which protects a stamp surface of a stamp surface forming material during transportation of the stamp unit, in storage until a user starts to produce a stamp plate after purchasing the stamp unit, and during production of the stamp plate. The transparent film is thermally adhered on the lower edge of the holder member and is capable of protecting the surface of the stamp surface forming material until starting the stamping. The invention provides a stamp having a transparent film which can be easily and economically adhered to a stamp surface forming material without the melted resin material sticking to the thermal adhesion jig.

BRIEF DESCRIPTION OF THE DRAWINGS

A preferred embodiment of the invention will be described in detail with reference to the following figures wherein.

DETAILED DESCRIPTION OF PREFERRED EMBODIMENT

Figure 1:
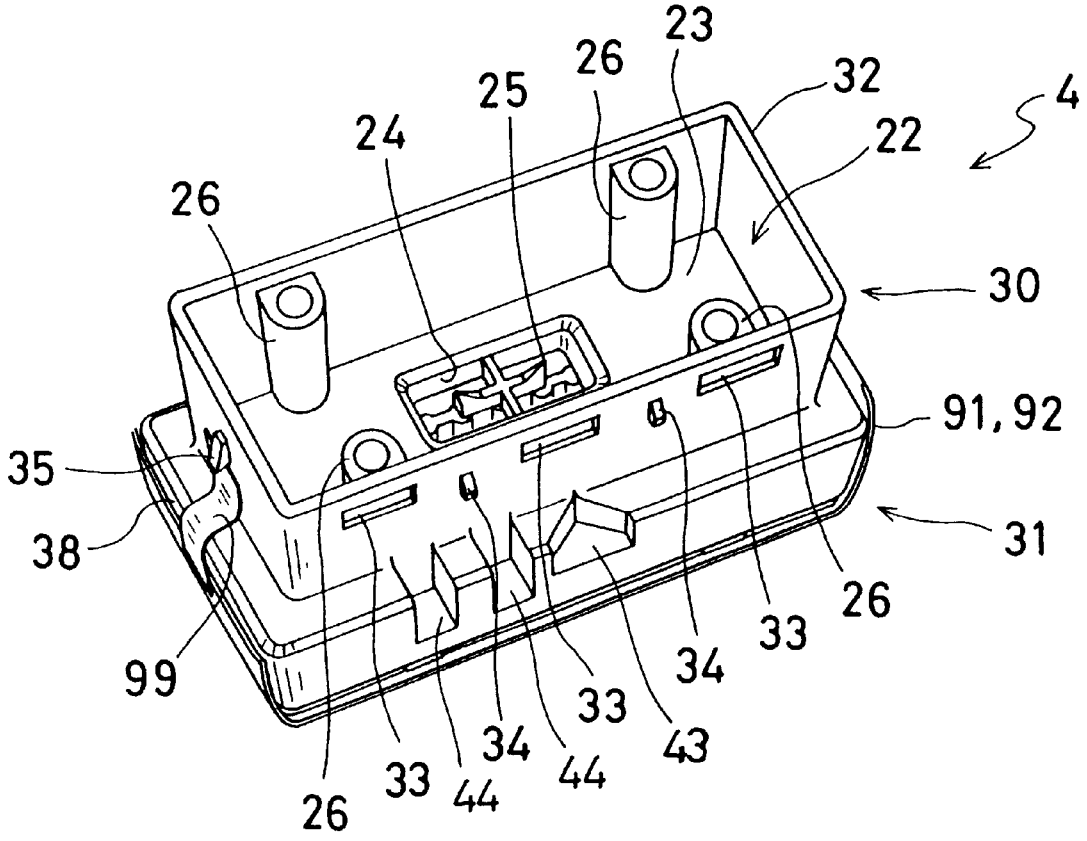
FIG. 1 is a perspective view of a holder member of a stamp unit according to a preferred embodiment.

A stamp unit according to a preferred embodiment of the invention will be described in detail referring to the drawings.

Figure 2:
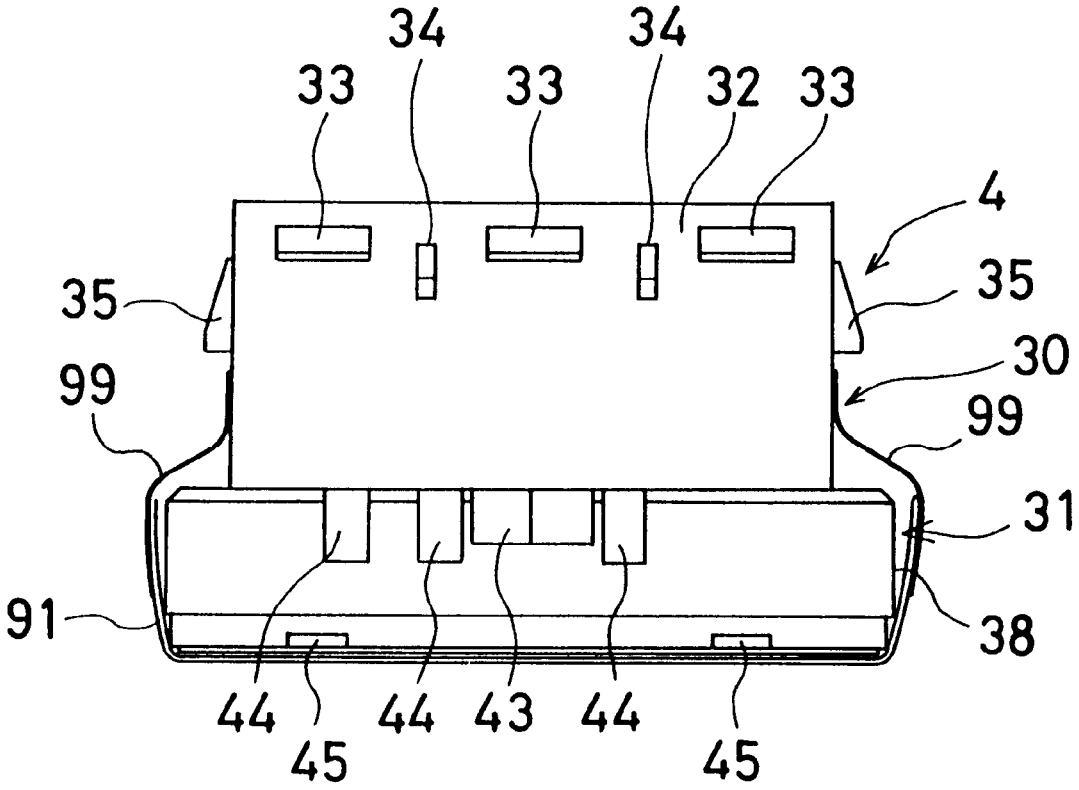
FIG. 2 is a side view of the holder member shown in FIG. 1.
Figure 3:
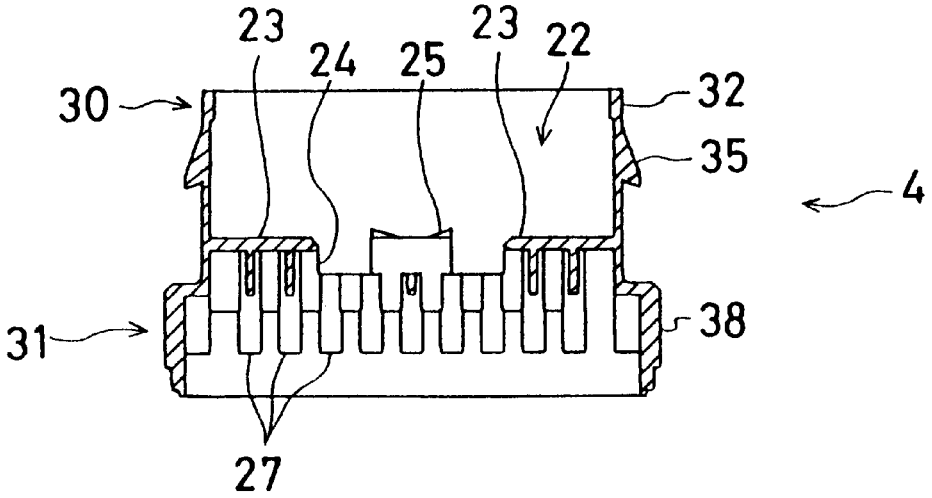
FIG. 3 is a sectional side view of the holder member shown in FIG. 1.
Figure 4:
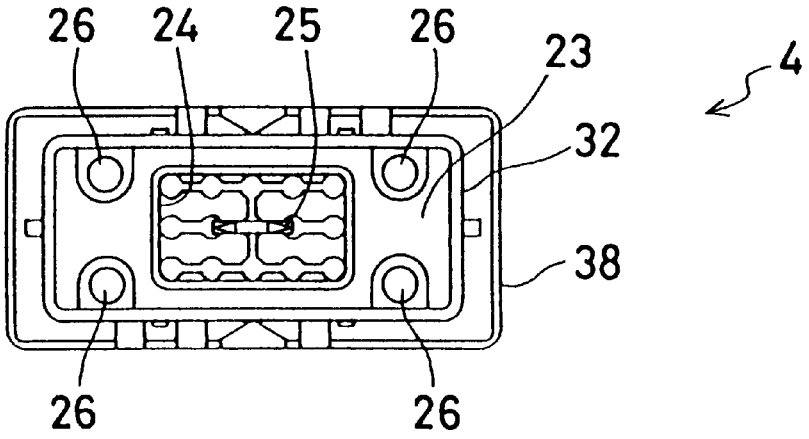
FIG. 4 is a top view of the holder member shown in FIG. 1.
Figure 5:
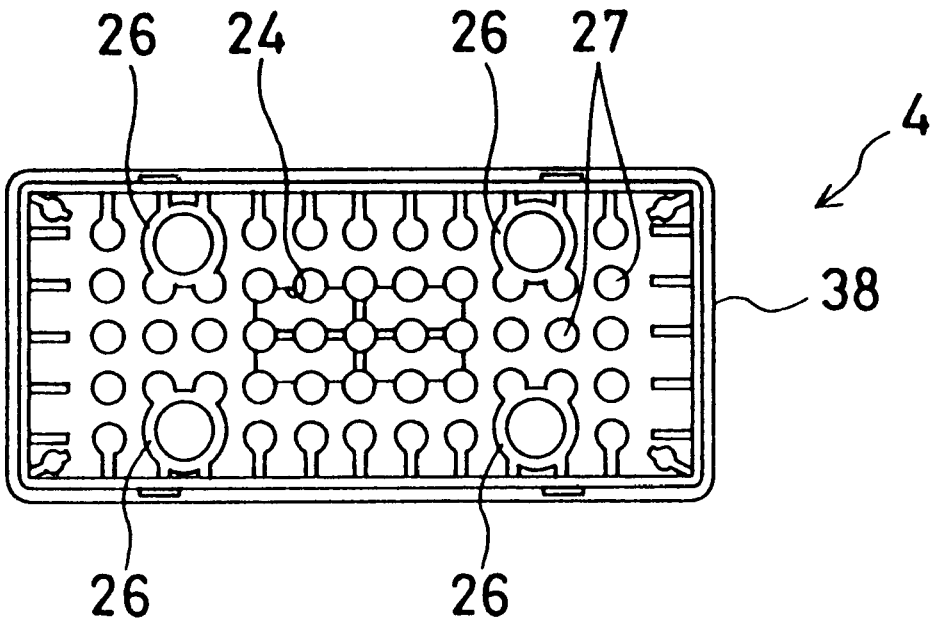
FIG. 5 is a bottom view of the holder member shown in FIG. 1.

FIG. 1 is a perspective view of a holder member 4 of a stamp unit 1; FIG. 2 is a side view; FIG. 3 is a sectional side view; FIG. 4 is a top view; and FIG. 5 is a bottom view of the holder member 4. In FIGS. 3 through 5, a stamp material and a transparent film are omitted in order to show the structure of the holder member 4 in detail. The holder member 4 is used as a part of the stamp unit 1 shown in a general exploded perspective view in FIG. 9. The stamp unit 1 comprises a skirt member 2 supporting the stamp unit 1 during stamp-printing, the holder member 4 disposed within the skirt member 2 for movement in an axial (up and down) direction and holding a thermally adhered stamp material 3 at a lower end portion, a grip member 5 connected to the holder member 4 for moving the holder member 4 downwardly and pressing the stamp material 3 against the printing sheet (not shown), and a cap member 60 for covering and protecting the stamp material 3 mounted to the holder member 4.

The holder member 4 will be described with reference to FIGS. 1 to 5. As shown in the figures, the holder member 4 is complementary to the upper skirt portion 13 and the lower skirt portion 15 of the skirt member 2 (refer to FIGS. 12 through 14) in shape and comprises an upper holder portion 30 and a lower holder portion 31 in a unitary body. An ink pack storing portion 22 of the holder member 4 can store an a bag-shaped ink pack 6 (refer to FIG. 9) filled with ink and is made from a film material.

The upper holder portion 30 includes a circumferential side wall 32 which has a rectangular shape when viewed from above. Three grooves 33 are provided in a horizontal line at an upper portion of the front side wall and the rear side wall (one wall is shown in FIG. 2) of the circumferential side wall 32. Regulating ribs 34, which are wedge-shaped and incline downward away from the outer surface of the front and rear side walls of the circumferential side wall 32, are provided on both sides of the center grooves 33. Rib engaging grooves 54 of the grip member 5 (refer to FIGS. 15 through 17) are engaged with each groove 33, so that the holder member 4 and the grip member 5 can be connected to form a single body. The regulating ribs 34 act to contact the upper end of the outer wall 12 of the upper skirt portion 13 of the skirt member 2 and to regulate the amount of the downward movement of the holder member 4.

Inclining protrusions 35 are wedge-shaped and inclined downwardly and outwardly from the outer surface of the end walls of the circumferential side wall 32 of the upper holder portion 30 (refer to the right and left side in FIG. 2). Each inclining protrusion 35 is inserted into an opposing vertical groove 19 (refer to FIG. 13) of the upper skirt portion 13 to be slidable in the axial direction when the holder member 4 is inserted from the under side of the skirt member 2. One end of a torsion spring 16 (refer to FIG. 13) is fixed at the lower end of the each respective inclining protrusion 35. The holder member 4 is supported slidably in an axial direction in the skirt member 2 by the cooperation of the inclining protrusion 35 and the vertical grooves 19. The other end of each torsion spring 16 is engaged by a spring engaging portion 17 (refer to FIG. 13) of the upper skirt portion 13. Thus, the engagement of the ends of the torsion springs 16 cause the holder member 4 always to be energized upward in the skirt member 2.

The ink pack storing portion 22 is of a substantially rectangular parallelpiped shape being surrounded by the circumferential side wall 32 of the upper holder portion 30 of the holder member 4. The ink pack storing portion 22 has a flat bottom surface 23 with an ink flow hole 24 substantially in the center and connected to the lower holder portion 31. Further, a cutting rib 25 protrudes a little beyond the bottom surface 23 and is provided in the ink flow hole 24 for cutting and opening the ink pack 6.

Four oval-shaped ink supply holes 26, which reach from proximate the top end of the holder member 4 to the bottom surface of support rods 27 (refer to FIG. 5), are provided on the inner surface of the ink pack storing portion 22 along the circumferential sidewall 32. The ink supply holes 26 are used to supplement the ink without using another ink pack 6 if the amount of ink in the stamp material 3 supplied by the ink pack 6 becomes insufficient. Ink is poured through the ink supply holes 26 with the grip member 5 detached.

Further, as shown in FIG. 5, a plurality of support rods 27, which are several millimeters in length, are provided so as to form a lattice on the lower holder portion 31 of the holder member 4. The support rods 27 extend down towards the bottom surface of the lower holder portion 31 and contact the stamp material 3 held by the holder member 4. The bottom ends of the support rods 27 substantially form a plane. The lower holder portion 31 is integrally formed to the upper holder portion 30 as a unitary body and has a circumferential side wall 38 which is larger than the circumferential side wall 32. The holder member 4 is made of polyolefine resin, such as ABS resin, polyacetal copolymer, polypropylene, polyethylene, nylon, or PC resin.

The cutting rib 25 acts, when the ink pack 6 is pressed downwardly via a thick paper plate 37 (FIG. 10) by the grip member 5, to cut and open the ink pack 6. The corner portions of the cutting rib 25 are formed to be sharp for reliably opening the ink pack 6. The ink flow hole 24 guides the ink flowing from the ink pack 6, opened by the cutting rib 25, downwardly where the ink impregnates the stamp material 3.

An inclined groove 43 (refer to FIGS. 1 and 2) is formed having an inwardly directed wedge shape at an outer center position of each longitudinal wall of the circumferential side wall 38 of the lower holder portion 31. One or two detecting grooves 44 are formed at the sides of inclined grooves 43. The inclined grooves 43 are used for setting the holder member 4 to a predetermined processing position in a stamp producing apparatus when forming a stamp plate from the stamp material 3 using the stamp producing apparatus, for example, such as disclosed in European unexamined Patent-Application Publication No. EP 0 798 114 A2. As both sides of inclined grooves 43 have an inclined surface, the holder member 4 is moved to position the positioning member in a positioning mechanism of a stamp producing apparatus (not shown) at the center portion of the inclined groove 43 based on a cam action between the positioning member and the inclined surfaces. Thereby, the holder member 4 is set to a predetermined processing position. The number of detecting grooves 44 and the position of the detecting grooves 44 are changed based on the size of holder member 4. The detecting grooves 44 specify the size of holder member 4 in cooperation with a groove sensor which is part of the positioning mechanism of the stamp producing apparatus. The position of the inclined groove 43 and the detecting grooves 44 on the surface of the circumferential side wall 38 are set to have identical positions regardless of which longitudinal side of the circumferential side wall 38 faces the positioning mechanism. This makes it makes possible to process the stamp material 3 regardless how the stamp unit 1 is seated at the predetermined processing position of the stamp producing apparatus.

As shown in FIG. 2, a pair of engaging protrusions 45 are formed on the lower position of the longitudinal walls of the circumferential side wall 38. The engaging protrusions 45 engage engaging grooves 62 of the cap member 60 (refer to FIG. 19) and are used to attach the cap member 60 to the lower end of the lower holder portion 31. The stamp surface of the stamp material 3 supported at the lower end of the side wall 38 is thus protected by the cap member 60.

Figure 6:
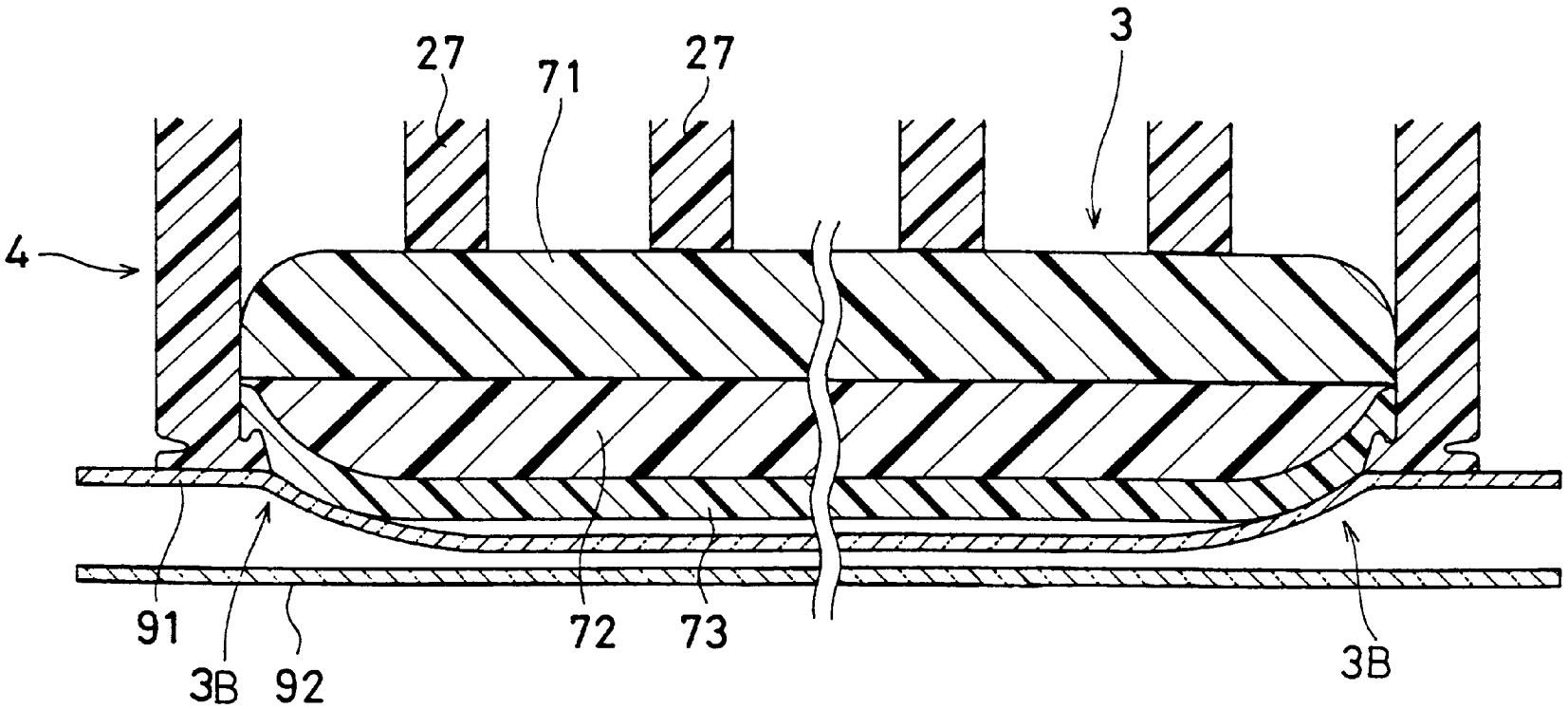
FIG. 6 is an expanded sectional view of a bottom portion of the holder member shown in FIG. 1.

In the lower surface of the holder member 4, the stamp material 3 is fitted nearly contacting with the support rods 27. Two transparent films 91, 92 are provided covering the stamp material 3. As shown in FIG. 6, the stamp material 3 is formed having a three layer structure. An upper layer 71 is made of a hard porous resin approximately 3 mm thick, such as a polyvinyl formal of 90% porosity. A middle layer 72 is made of a hard porous resin, approximately 2 mm thick, such as the same material as the upper layer 71. A lower layer 73 is made of a soft porous resin, such as a urethane resin of 65% porosity, with a light energy absorption material, such as carbon black, being dispersed therein. The middle layer 72 and the lower layer 73 are adhered to each other by an adhesive agent pasted in a lattice shape. The upper layer 71 and the middle layer 72 are not adhered artificially.

The weight percent of carbon black included in the lower layer 73 is 0.1 to 15 WT %, more preferably 1.0 to 15 WT %, if polyurethane foaming resin is used, for example. As the light energy absorption material other than carbon black, silver chloride or silver bromide can be used. As the material constituting the lower layer 73, other than the urethane resin, polyolefine resin, polyvinyl chloride resin or rubber resin can be used.

The three layer structure of the stamp material 3 has the following advantage. It is desired that the number of printings after ink is supplied using the ink pack be in the range of 5,000 to 10,000 printings. For that, the thickness of the hard porous resin of the stamp material must be increased. However, if the thickness of the hard porous resin is increased too much, too many burrs occur while cutting and processing to the predetermined shape. If there are too many burrs, the desired shape of the resin layer cannot be obtained or an additional cutting or finishing process is necessary. Therefore, in the preferred embodiment, the thickness per layer is minimized and the overall thickness of the hard porous resin is ensured by using a plurality of hard porous resin layers. The problem of burrs is avoided in such a case and the ink can be stored in more than the desired amount in the hard porous resin layers.

In the stamp unit of the invention, one transparent film can be thermally adhered to the holder member 4. However, depending on the situation, it can be that the insulation effect provided by a single transparent film is not enough. The heat generated from the portion where characters or images are printed on the transparent tape, by exposing to the light source, is also transferred to the stamp material through the transparent film. As a result, the portion which should be remain as it is, that is, unmelted and porous, is melted and solidified. To prevent this, a thicker film can be used to strengthen the insulation effect. However, doing so can cause another problem in that the thermal adhesion between the transparent film, the stamp material and the holder member may be incomplete and the transparent film can then be easily peeled off if a thick film is used. Therefore, in this embodiment, two layers of transparent film are used to provide enough insulation effect and obtain firm thermal adhesion as described below.

FIG. 6 is an expanded sectional view of a bottom portion of the holder member 4. Transparent films 91, 92 are formed from a single film folded in two. As shown in FIGS. 1 and 2, both ends of the transparent films 91, 92 are adhered to the side wall 38 with an adhesive tape 99. The transparent film 91 is thermally adhered with the stamp material 3 and the holder member 4 respectively at an edge portion 3B of the stamp material 3. On the other hand, the transparent film 92 is separated from the transparent film 91, and is not adhered to the stamp material 3 and the holder member 4. Both of the transparent films 91, 92 are approximately 0.025 mm–0.2 mm thick, and made of a resin film, such as PEN (polyethylene naphthalate), polyamide, whose melting point is approximately 250° C. which is higher than a general film, such as PET (polyethylene terephthalate) film. Therefore, the melting point of the transparent films 91, 92 is higher than that of the lower layer 73 (soft porous polyurethane resin is approximately 105–110° C., and soft porous polyolefine resin is approximately 70° C.) and that of the holder member (approximately 180–200° C.).

Figure 7:
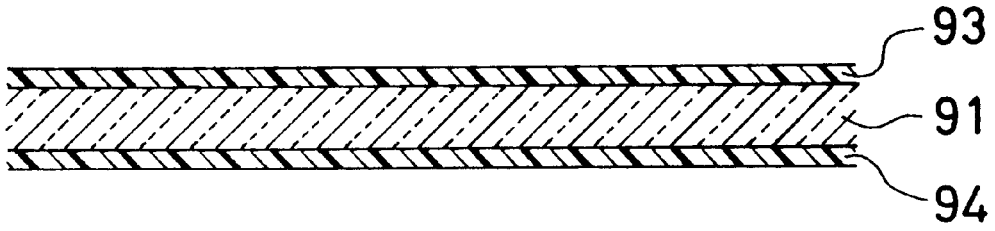
FIG. 7 is an expanded sectional view of a transparent film used in the holder member shown in FIG. 1.

FIG. 7 is an expanded sectional view of the transparent film 91. As shown in FIG. 7, silicone resin layers 93, 94, several micro meters thick, are provided on the upper and lower sides of the transparent film 91. Though not shown in figures, the transparent film 92 is also coated with silicone resin layers in the same manner. The silicone resin layers 93, 94 have the following features. They decrease the adhesive strength between the lower layer 73 and the transparent film 91, and reduce the force necessary to peel the transparent film 91 from the lower layer 73. Also, the silicone resin layers 93, 94 decrease the adhesive strength between the transparent film 92 and the ink of the positive copy, decrease the adhesive strength between the transparent film 92 and the thermal adhesion jig 102 (refer to FIG. 8), and reduce the force necessary to release the transparent film 92 from the jig 102. The silicone resin layers 93, 94 show the above features at least at the melting temperature of the lower layer 73.

The silicone resin layer 93 which is provided on the surface of the transparent film 91 facing the stamp material 3 acts to peel off easily the transparent film 91 from the lower layer 73 of the stamp material 3. In the holder member 4 of the present embodiment, the transparent film 91 adhered to the lower layer 73 of the stamp material 3, at the time of thermal adhesion among the stamp material 3, the holder member 4 and the transparent film 91, or at a time of making the stamp plate, can be easily peeled off from the lower layer 73 after making the stamp plate. Therefore, it can be prevented that the lower layer 73 of the stamp material 3 adheres to the transparent film 91 side and is peeled from the stamp material 3 when the transparent film 91 is peeled off after making the stamp plate. According to the holder member 4 of the embodiment, ink leakage, caused by the peeling off of the soft porous resin layer, such as the lower layer 73 of the stamp material 3, can be suppressed. Further, the same effect can be obtained by coating with fluorine resin layers instead of the silicone resin layers 93, 94.

In the holder member 4 of the embodiment, the transparent films 91, 92 cover the stamp material 3 so that the stamp surface of the stamp material 3 can be protected until the stamp plate is made. The melting point of the transparent films 91, 92 is higher than that of the stamp material 3 and the holder member 4, so as to prevent the resin material included in the stamp material 3 and the holder member 4 from sticking to the thermal adhesion jig 102 at the time of thermal adhesion. Further, the transparent films 91, 92 act as an insulation wall at the time of producing the stamp plate, so that a part of the lower layer 73 which should not be melted, that is where the desired stamp image will be formed, is prevented from melting, and good stamp quality can be obtained.

Further, the silicone resin layer 94 coated on the surface of the transparent film 92 opposite to the stamp material 3 acts to permit the transparent film 92 to peel easily from the ink of the positive copy, and to permit the transparent film 92 to peel easily from the thermal adhesion jig 102. In the holder member 4 of the embodiment, it can be prevented that the ink of the positive copy sticks to the transparent film 92 at the time of producing the stamp plate, and that the resin material of the transparent film 92 sticks to the thermal adhesion jig 102 at the time of the thermal adhesion. Therefore, the positive copy is not damaged, and the copy can be used many times. Further, there is no need to perform a special treatment of the thermal adhesion jig.

In the embodiment, two layers of transparent film 91, 92 are used. Therefore, the lower layer 73 of the stamp material, which should not be melted so that the desired stamp image will be formed therein, is prevented from melting more effectively than by a one layer transparent film, and the insulation effect of the transparent films 91, 92 can be strengthened. The two layers of transparent films 91, 92 effectively prevent the transmission of the heat generated at the printed portion of the positive copy, caused by exposure to the light emitting member, to the stamp material 3. Therefore, good stamp quality is obtained. Further, in the embodiment, the silicone resin layers 93, 94 are coated on both sides of the transparent films 91, 92 respectively, so that the stronger insulation effect can be obtained, and the better stamp quality can be obtained.

Figure 8:
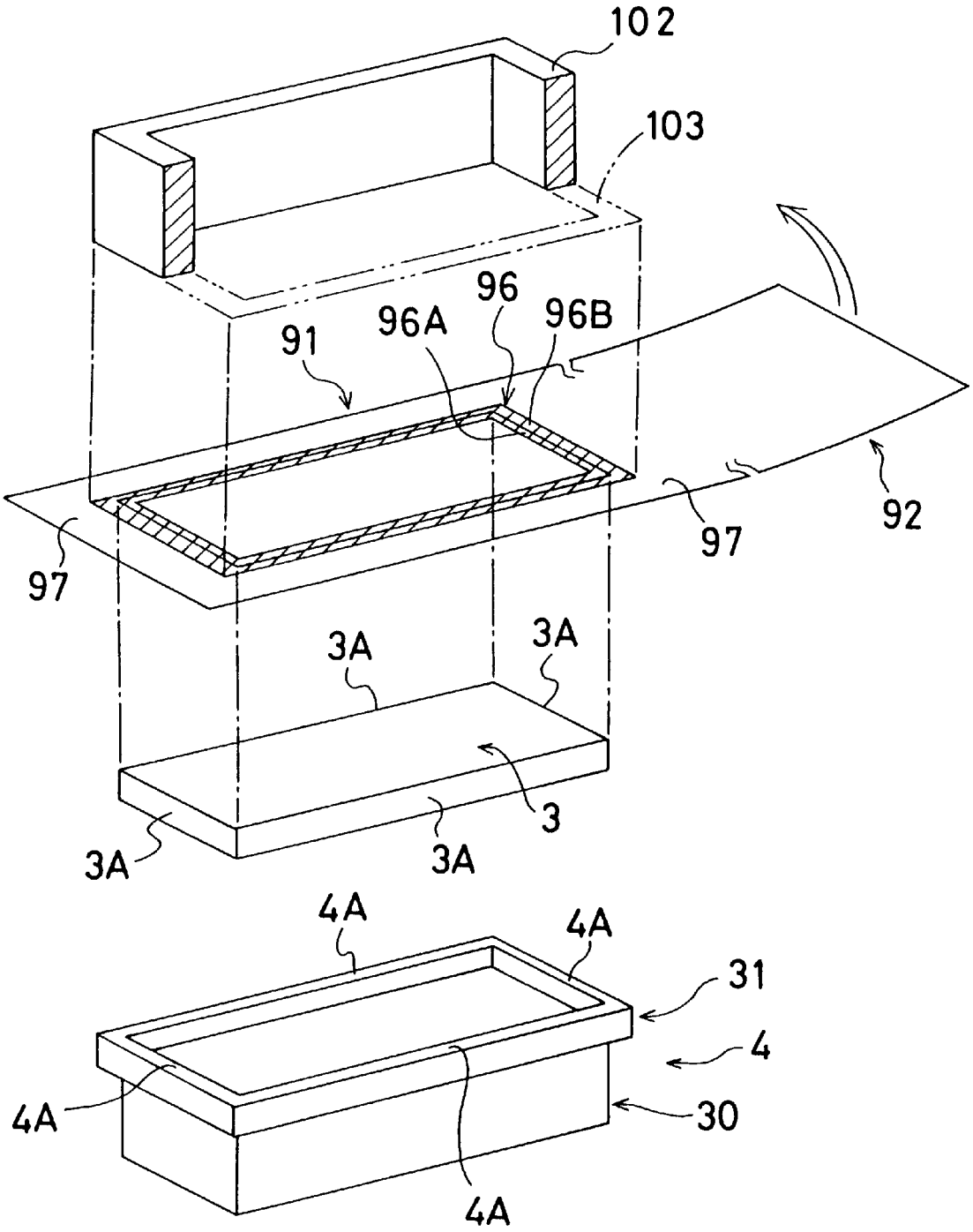
FIG. 8 is an exploded perspective view schematically showing a condition where the stamp material and the transparent film adheres to the lower edge of the holder member.

Next, a method to thermally adhere the stamp material 3 and the transparent film 91 to the lower edge of the holder member 4 is explained with reference to FIG. 8. FIG. 8 is an exploded perspective view schematically showing the stamp material 3 and the transparent film 91 for adherence to the lower edge 4A of the holder member 4. The holder member 4 is arranged with the lower holder portion 31 upwardly, therefore, the lower edge 4A is positioned in the upper position.

In FIG. 8, the thermal adhesion jig 102 is formed having a rectangular shape when viewed from the above. Heat control for the thermal adhesion jig 102 is performed by a heat control device (not shown). A heating temperature (adhesion temperature) is set between 200° C. to 240° C. The thermal adhesion jig 102 has an adhesion surface 103 corresponding to the shape of the thermal adhesion jig 102. The transparent film 91 is constituted from one film, and is continued to the transparent film 92. The melting point of the resin material forming the transparent film 91 is lower than that of the thermal adhesion jig 102, and is higher than that of the resin material included in the holder member 4 and the stamp material 3. A margin for adhesive material 96 is formed on the transparent film 91 corresponding to the adhesion surface 103 of the thermal adhesion jig 102. The margin for adhesive material 96 has two parts, an inner margin 96A corresponding to the portion where a side edge 3A of the stamp material 3 adheres to an inner side of a lower edge 4A of the holder member 4, and an outer margin 96B corresponds to the width of the lower edge 4A of the holder member 4. A grip portion 97 is formed around the outer periphery of the margin for adhesive material 96 on the transparent film 91.

In the above structure, the method to thermally adhere the transparent film 91 to the lower edge 4A of the holder member 4 is as follows. First, the holder member 4 is arranged as shown in FIG. 8, and the stamp material 3 is arranged inside the lower holder portion 31 of the holder member 4. Then, the transparent film 91 is placed thereon so as to cover the stamp surface of the stamp material 3. The thermal adhesion jig 102, heated at the predetermined temperature, is moved downwardly, the adhesion surface 103 of the thermal adhesion jig 102 is fitted to the margin for adhesive material 96 of the transparent film 91, and the thermal adhesion jig 102 is pressed downwardly, and kept engaged for a predetermined period, that is, 1 to 5 seconds, more preferably 3 seconds.

Thereby, the side edge 3A of the stamp material 3 and the inner side of the lower edge 4A of the holder member 4 are adhered respectively. The margin for adhesive material 96A of the transparent film 91 and an upper portion of the side edge 3A of the stamp material 3 are adhered such that they can be separated easily. Simultaneously, the margin for adhesive material 96B of the transparent film 91 and the lower edge 4A of the holder member 4 are adhered such that they can be separated easily. As mentioned above, the stamp material 3, the holder member 4 and the transparent film 91 are adhered simultaneously by the thermal adhesion jig 102. After the transparent film 91 is adhered, the transparent film 92 is folded in the direction, indicated by the arrow in FIG. 8, so that the transparent film 91 and the transparent film 92 are folded in two. Both ends of the transparent films 91 and 92, folded in two, are adhered on the circumferential side walls 32, 38 by the adhesive tape 99.

In the holder member 4 of the embodiment, when the stamp material 3 and the holder member 4 are thermally adhered to each other, only the transparent film 91 is adhered. The transparent film 92 is not thermally adhered to any of the foregoing, it is only folded to overlap the transparent film 91 after the transparent film 91 is thermally adhered. Therefore, good heat transmission can be obtained, and the transparent film 91 can be firmly, but releasably, adhered to the stamp material 3 and the holder member 4.

Further, in the holder member 4 of the embodiment, the transparent films 91, 92 are obtained by folding one film in two, therefore the transparent film can be easily produced because it is not necessary to overlap two different transparent films at the time of producing the films.

The transparent film 91, the stamp material 3 and the holder member 4 include resin material respectively. The melting point of the resin material forming the transparent film 91 is higher than that of the resin material included in the holder member 4 and the stamp material 3, and the silicone resin layers 93, 94 are coated on both sides of the transparent film 91 as a releasing material. Therefore, the resin material included in the transparent film 91 is not strongly adhered to the lower edge 4A of the holder member 4 and can be easily peeled from the holder member 4 at the time of starting stamp printing.

Further, the transparent film 91, the stamp material 3 and the holder member 4 can be thermally adhered simultaneously by using the thermal adhesion jig 102. Therefore the thermal adhesion can be performed easily by a one time adhering operation.

Further, as the transparent film 91 is made of a transparent resin film, the stamp plate can be produced in the condition that the transparent film 91 covers the stamp material 3. Therefore, the stamp surface of the stamp material 3 can be protected at the time of producing the stamp plate.

Further, as the grip portion 97 is formed on an outer periphery of the margin for the adhesive material 96 on the transparent film 91, the transparent film 91 can be peeled from the holder member 4 easily at the time of starting stamp printing.

Next, the stamp unit 1, including the above mentioned holder member 4, will be described with reference to FIGS. 9 through 11.

Figure 9:
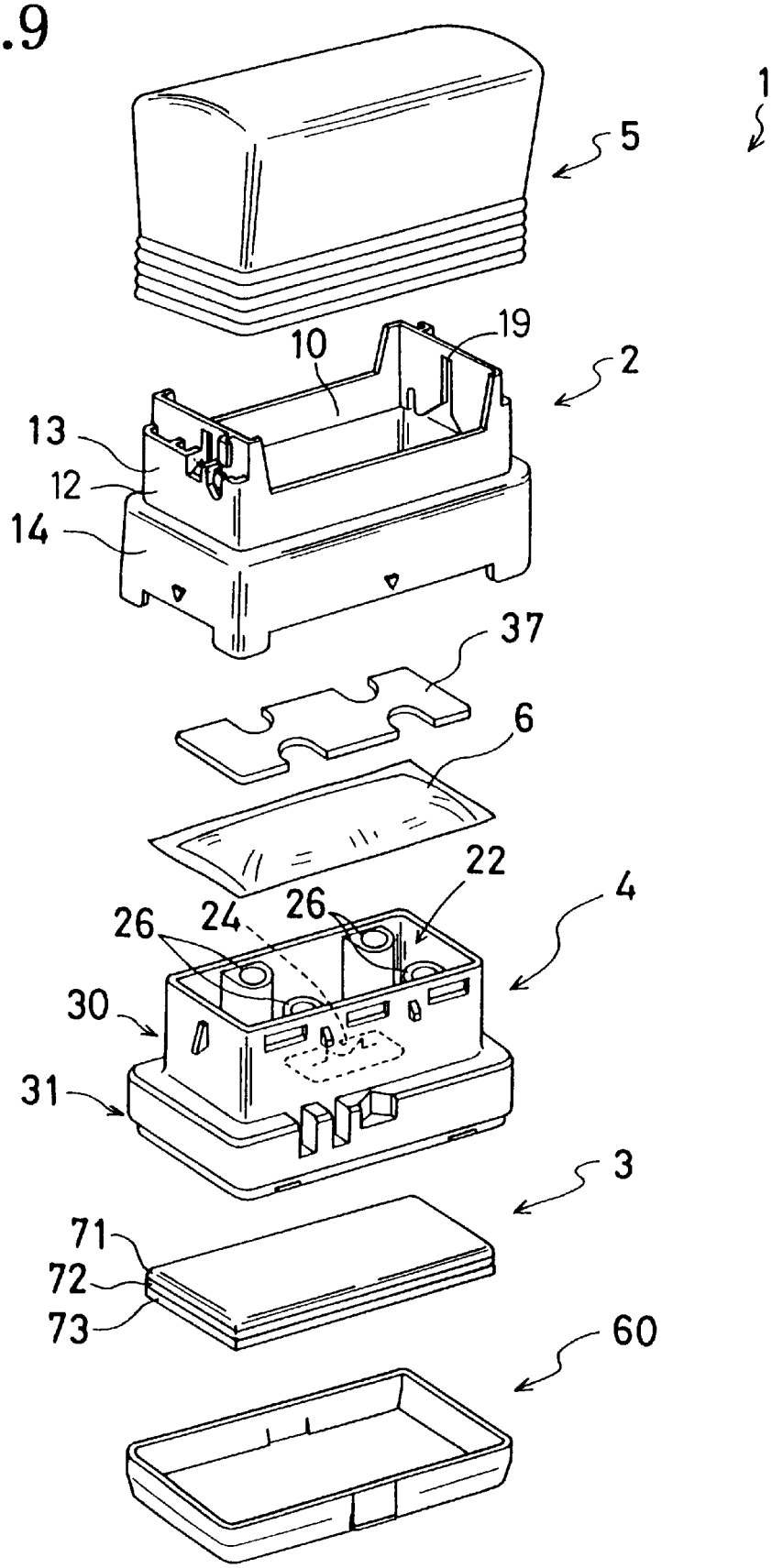
FIG. 9 is a general exploded perspective view of a stamp unit using the holder member shown in FIG. 1.

FIG. 9 is an exploded perspective view of the stamp unit 1; FIG. 10 is a sectional side view of the stamp unit 1 storing an unopened ink pack 6; and FIG. 11 is a sectional side view of the stamp unit 1 immediately after the ink pack 6 is opened.

An ink pack storing portion 22 of the holder member 4 is capable of storing a bag-shaped ink pack 6 made of a film material and filled with ink. Substantially the same amount of ink storable in the stamp material 3 is contained in the ink pack 6. The thick paper plate 37 is arranged between the ink pack 6 and the lower surface of the grip member 5. Polyethylene, polypropylene, polyester, nylon, for example, can be used as the film material of the ink pack 6. The film of one of the identified materials alone or a film made by laminating two or more of the materials to make the ink pack 6.

Figure 12:
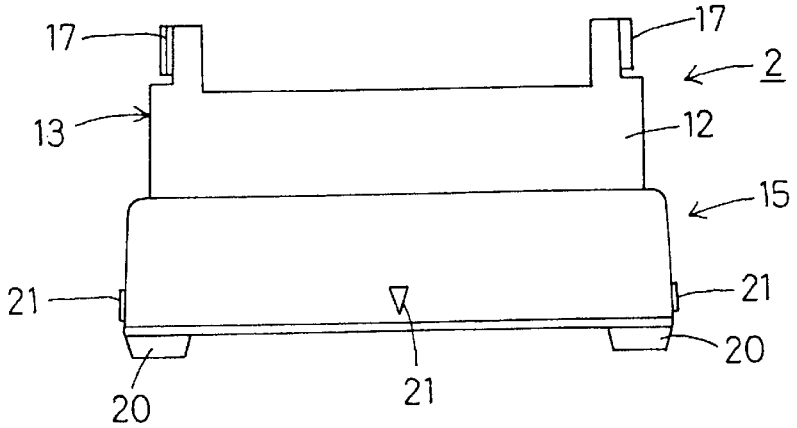
FIG. 12 is an side view of a skirt member shown in FIG. 9.
Figure 13:
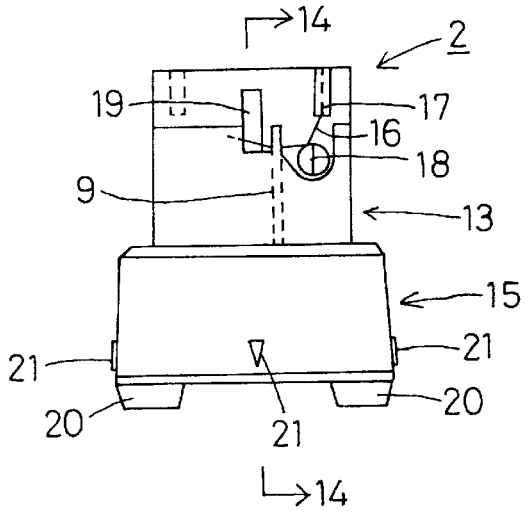
FIG. 13 is an end view of the skirt member shown in FIG. 9.
Figure 14:
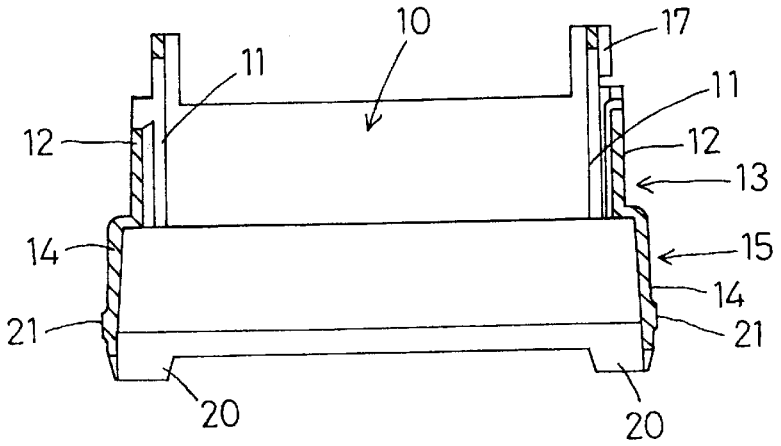
FIG. 14 is a sectional side view of the skirt member shown in FIG. 9.

Next, the skirt member 2 will be described using FIGS. 12 through 14. FIG. 12 is a side view; FIG. 13 is an end view; and FIG. 14 is a sectional side view of the skirt member 2.

As shown in the figures, the skirt member 2 has a opening portion 10 having a rectangular shape and an inner wall 11. The holder member 4 slides relative to the surface of the inner wall 11 within the opening portion 10. The skirt member 2 is integrally composed of an upper skirt portion 13 and a lower skirt portion 15. The upper skirt portion 13 has an outer wall 12 formed with the inner wall 11 but outside the inner wall 11. The lower skirt portion 15 has an outer wall 14 formed continuously to the outer wall 12 in a stepped relationship so as to have a larger circumference.

The spring engaging portion 17, which engages an end of the torsion spring 16, is formed at the upper portion of the inner wall 11 at both the left and right end surfaces of the upper skirt member 13. A positioning protrusion 18, which has a half-moon shape, receives the coil portion of the torsion spring 16. The positioning protrusion 18 is formed below and inclined or offset from the spring engaging portion 17 (refer to FIG. 13). Further, a vertical groove 19, which receives slidably therein the inclining protrusion 35 (as shown in FIGS. 1 through 3) is formed in both of the end surfaces of the holder member 4 at a center portion of the inner wall 11. The vertical grooves 19 act to guide the inclining protrusions 35 of the holder member 4 in the axial direction when the holder member 4 is moved downward while printing. A spring shift suppression member 9 has an aperture portion (not shown), to prevent disengagement of the torsion spring 16, through which one end of the torsion spring 16 passes. Further, the lower end of the inclining protrusion 35 engages the end of the torsion spring 16 during up and down movement to regulate that movement as the torsion spring 16 end moves in the aperture portion of the spring shift suppression member 9. The spring shift suppression member 9 is provided between the vertical groove 19 and the positioning protrusion 18.

The lower skirt portion 15 is set on the print sheet and supports the stamp unit 1 while stamp printing is proceeding. Support ribs 20 support the lower edge of the outer wall 14 keeping it away from the surface of the print sheet and are disposed at the lower corner portions of the outer wall 14. A down arrow 21, which shows a stamp printing direction, is formed at the center portion of the outer wall 14.

Figure 15:
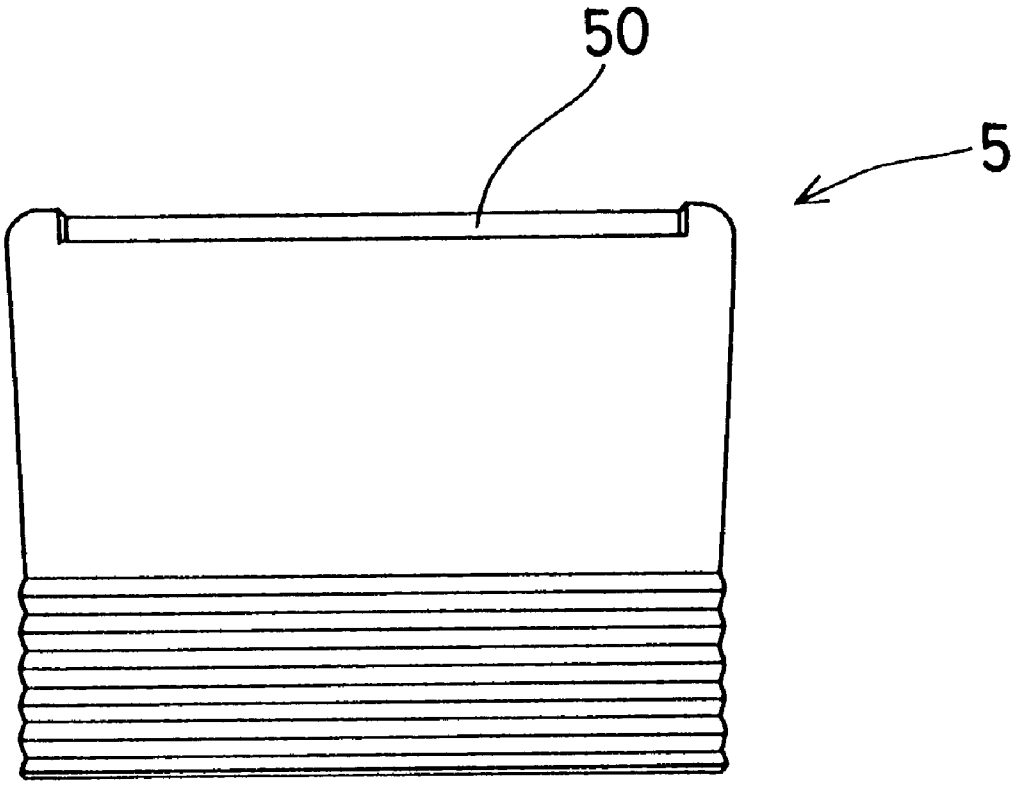
FIG. 15 is a side view of a grip member shown in FIG. 9.
Figure 16:
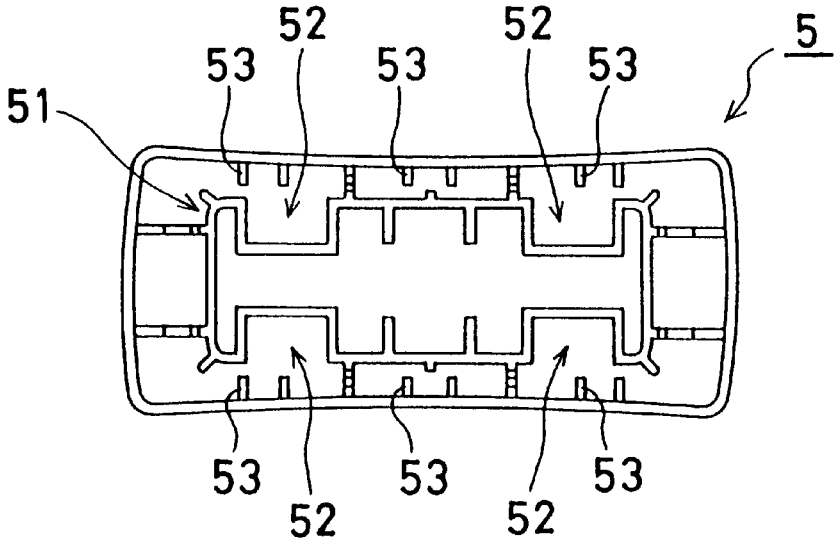
FIG. 16 is a bottom view of the grip member shown in FIG. 9.
Figure 17:
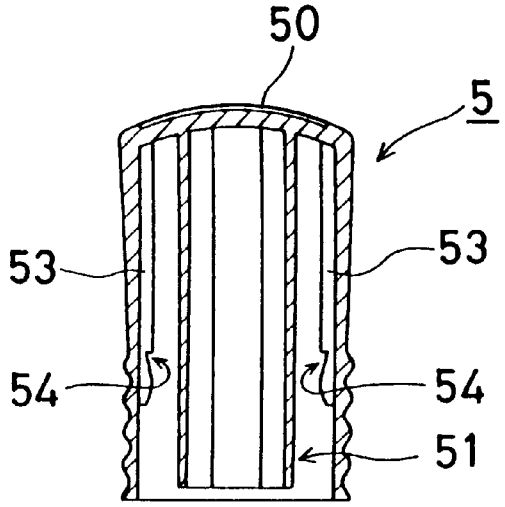
FIG. 17 is a transverse sectional view of the grip member shown in FIG. 9.

Next, the grip member 5 will be described with reference to FIGS. 15 through 17. FIG. 15 is a side view; FIG. 16 is a bottom view; and FIG. 17 is a transverse sectional view of the grip member 5.

In the figures, a label portion 50 is formed on the upper surface of the grip member 5. A label, which indicates the contents of the stamp formed on the stamp material 3 by the previously described method, is pasted on the label portion 50. Further, an insertion portion 51, which is inserted into the circumferential side wall 32 of the upper holder portion 30 of the holder member 4, is formed on the inside surface of the top of the grip member 5 as shown in FIGS. 10, 16 and 17. The insertion portion 51 acts to press against the ink pack 6, disposed in the holder member 4, through the thick paper plate 37.

The insertion portion 51 has a substantially rectangular shape when viewed from the bottom as shown in FIG. 16. Concave portions 52 are formed at opposed positions at the center peripheral portion of the insertion portion 51. The concave portions 52 permit the insertion portion 51 to bypass the wall portions forming the ink supply holes 26 disposed on a surface of the circumferential side wall 32 when the insertion portion 51 of the grip material 5 is inserted into the circumferential side wall 32 of the holder member 4. The reason why two pairs of concave portions 52 are provided is to prevent the wall portion of the ink supply hole 26 from being an obstacle and to allow the grip member 5 to be inserted with either side opposing the ink supply holes 26. Further, a plurality of ribs 53 (12 ribs are shown in FIG. 16) are formed in a vertical direction on the inner surface of the outer wall of the grip member 5. A rib engaging groove 54 defining a rib protrusion is integrally formed at the lower end of each rib 53. The rib protrusion is received in the above mentioned opposed groove 33 formed on the upper surface of the outer wall of the circumferential side wall 32, whereby the holder member 4 and the grip member 5 are integrated or assembled.

Figure 18:
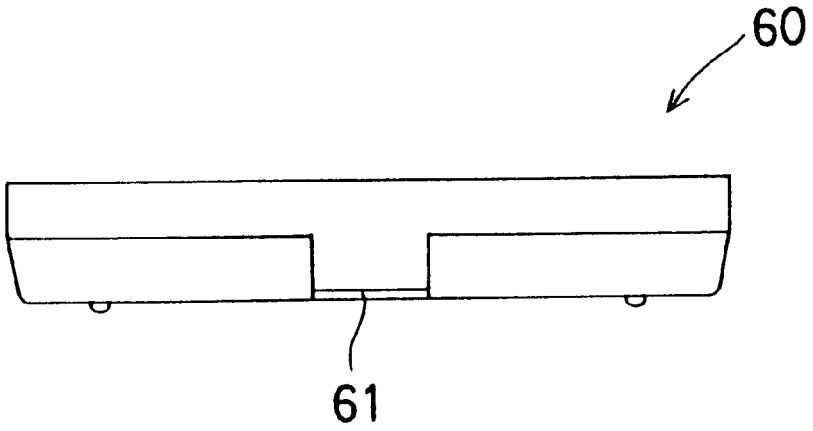
FIG. 18 is a side view of a cap member shown in FIG. 9.
Figure 19:
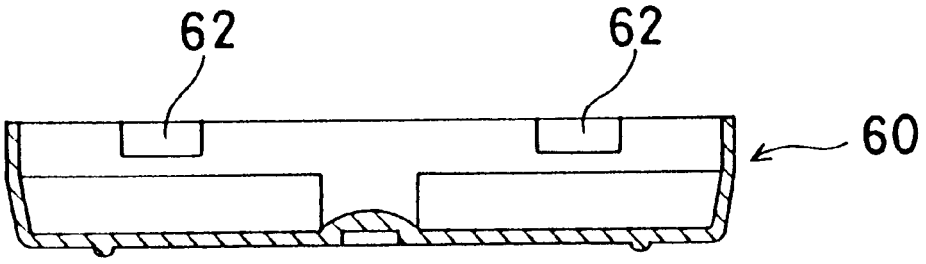
FIG. 19 is a sectional side view of the cap member shown in FIG. 9.

Next, the cap member 60 for mounting at the lower end portion of the lower holder portion 31 of the holder member 4 will be described with reference to FIGS. 18 and 19. FIG. 18 is a side view and FIG. 19 is a sectional side view of the cap member 60. As shown in the figures, the cap member 60 is box-shaped having an opening upward. The hand holding portion 61, which is held by the operator's fingers when fixing the cap member 60 onto or detaching it from the holder member 4, is formed substantially at the center portion of both sides of the surface of the outer wall, as shown in FIG. 18. Further, a pair of engaging grooves 62, which are engaged with the engaging protrusions 45 formed on the circumferential side wall 38 of the holder member 4, is provided on both sides of the inner surface of the peripheral wall of the cap member 60. The cap member 60 is attached to the circumferential side wall 38 by each engaging groove 62 of the cap member 60 being engaged with an opposed engaging protrusion 45 of the side wall 38. Thereby, the stamp surface of the stamp material of the print member 3, which is located near the lower end of the circumferential side wall 38 is protected by the cap member 60.

Figure 20:
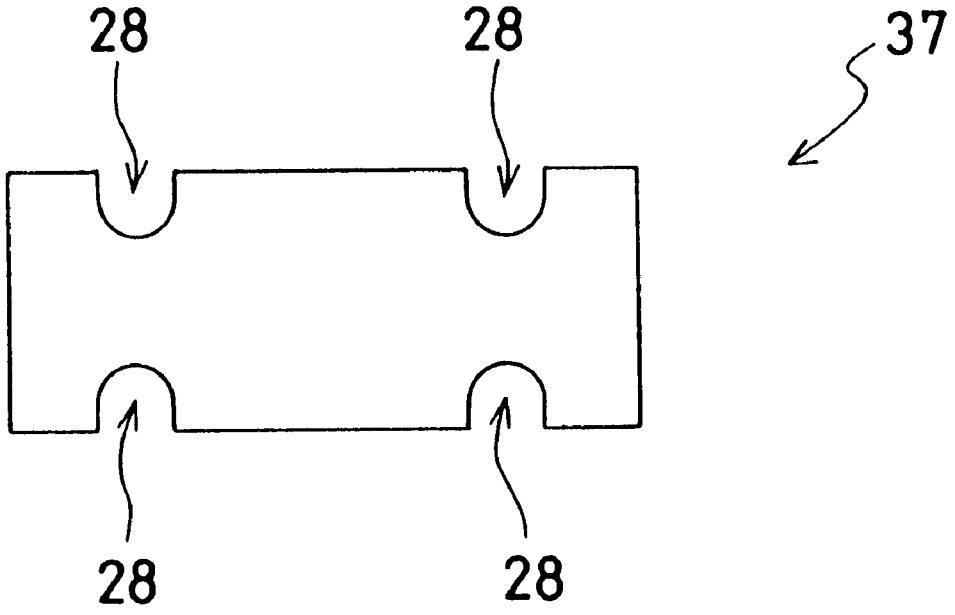
FIG. 20 is a top view of a thick paper plate shown in FIG. 9.

As shown in FIG. 20, the thick paper plate 37 has four concave portions 28 corresponding to the flat shape of the ink pack storing portion 22 of the holder member 4 and is formed a little bit larger than the inner size of the ink pack storing portion 22. As shown in FIG. 10, if the grip member 5 is moved downward against the holder member 4 when an ink pack 6 is located in the ink pack storing portion 22, the pressing power from the grip member 5 is exerted on the ink pack 6 substantially uniformly by the thick paper plate 37.

Thus, the ink pack 6 is sandwiched between the bottom surface 23 of the ink pack storing portion 22 and the thick paper plate 37 and the ink pack 6 is cut and opened by the cutting rib 25. Then, as shown in FIG. 11, the ink pack 6 is pressed between the two flat planes, therefore ink in the ink pack 6 flows downward through the ink flow hole 24 and is supplied to the stamp material 3. Thus, by sandwiching the ink pack 6 between the two flat planes, the bottom surface 23 of the ink pack storing portion 22 and the thick paper plate 37, the ink flows without any ink remaining in the ink pack 6 and the ink is supplied to the stamp material 3 without waste.

Further, in the stamp unit 1 of the embodiment, the cutting rib 25 for cutting the ink pack 6 projecting from the bottom surface 23 is provided within the ink flow hole 24. Therefore, the ink pack 6 can be opened easily by the cutting rib 25 when the grip member 5 and the holder member 4 are combined. Further, as the cut rib 25 is provided in the ink flow hole 24, the cutting position of the ink pack 6 opposes the ink flow hole 24. Therefore, the ink flows from the ink pack 6 into the ink flow hole 24 quickly. Therefore, the time it takes for ink to reach the stamp material 3 after the ink pack 6 is opened is shortened. Further, even if the cutting rib 25 is not provided, the ink pack 6 can be opened by sandwiching the ink pack 6 between the bottom surface 23 of the ink pack storing portion 22 and the thick paper plate 37. However, the embodiment has the advantage of that it needs less power to cut the ink pack 6 by providing the cutting rib 25.

Further, as the side edge of the thick paper plate 37 can be adjusted if necessary, the thick paper plate 37 can be easily disposed in the holder member 4 on the upper side of the ink pack 6. Also, the thick paper plate 37 can be fixed at the desired position in the holder member 4. Thereby, the stamp unit 1 can be transported with the ink pack 6 in place in the holder member 4. Further, because the thick paper plate 37 is capable of absorbing ink, the thick paper plate 37 absorbs any ink that flows from the ink pack 6 toward the upper side and prevents ink from leaking from the stamp unit 1.

In order to produce the stamp unit 1, first, the holder member 4 on which the transparent films 91, 92 shown in FIG. 1 are provided, is set to the predetermined processing position of the stamp producing apparatus (not shown) by the cam action between the inclined surface of the inclined groove 43 formed at the lower holder portion 31 and a positioning member of the positioning mechanism. Further, the size of the holder member 4 is specified by the detecting grooves 44 in cooperation with a groove sensor of the positioning mechanism.

A roll-shaped transparent film is transported within the stamp producing apparatus. As the film is transported, character and image data are printed thereon using a thermal head and an ink transfer ribbon of the stamp producing apparatus to produce a positive copy of the desired stamp image. The positive copy and the stamp material 3 are then set so as to oppose each other. When a light emitting member, such as a xenon tube or a laser light source, emits light under this condition, the lower portion 73 of the stamp material 3 is lighted through the positive copy. Only the part of the lower portion 73 of the stamp material 3, which is lighted th rough the transparent portion of the positive copy, is melted, and, as a result, solidified and sealed. The lower portion 73 of the stamp material 3, which has neither melted nor solidified, remains as it is and is in the form of characters and the like of the desired image. Thereby, the stamp plate, including both a sealed portion and an unsealed portion, is produced on the lower surface of the stamp material 3.

After the stamp material 3 is processed, the transparent films 91, 92 are peeled from the holder member 4. The coil portion of the torsion springs 16 are positioned on the positioning protrusions 18 and the holder member 4 is inserted into the opening portion 10 of the skirt member 2 while the spring engaging portions 17, at each end, are engaged with an end of the respective torsion spring 16. At this time, the inclining protrusions 35, which are formed on the outer end surfaces of the circumferential side wall 32 of the upper holder portion 30 of the holder member 4, are slid upward in the vertical grooves 19 of the skirt member 2. Further, the other end of each of the torsion springs 16 passes over the inclined surface and engages the lower portion of the respective inclining protrusion 35. At this time, the holder member 4 is pushed upwardly, in the skirt member 2, by the power of the torsion springs 16 and the holder member 4 is slidable downwardly against the upward force of the torsion springs 16.

Figure 10:
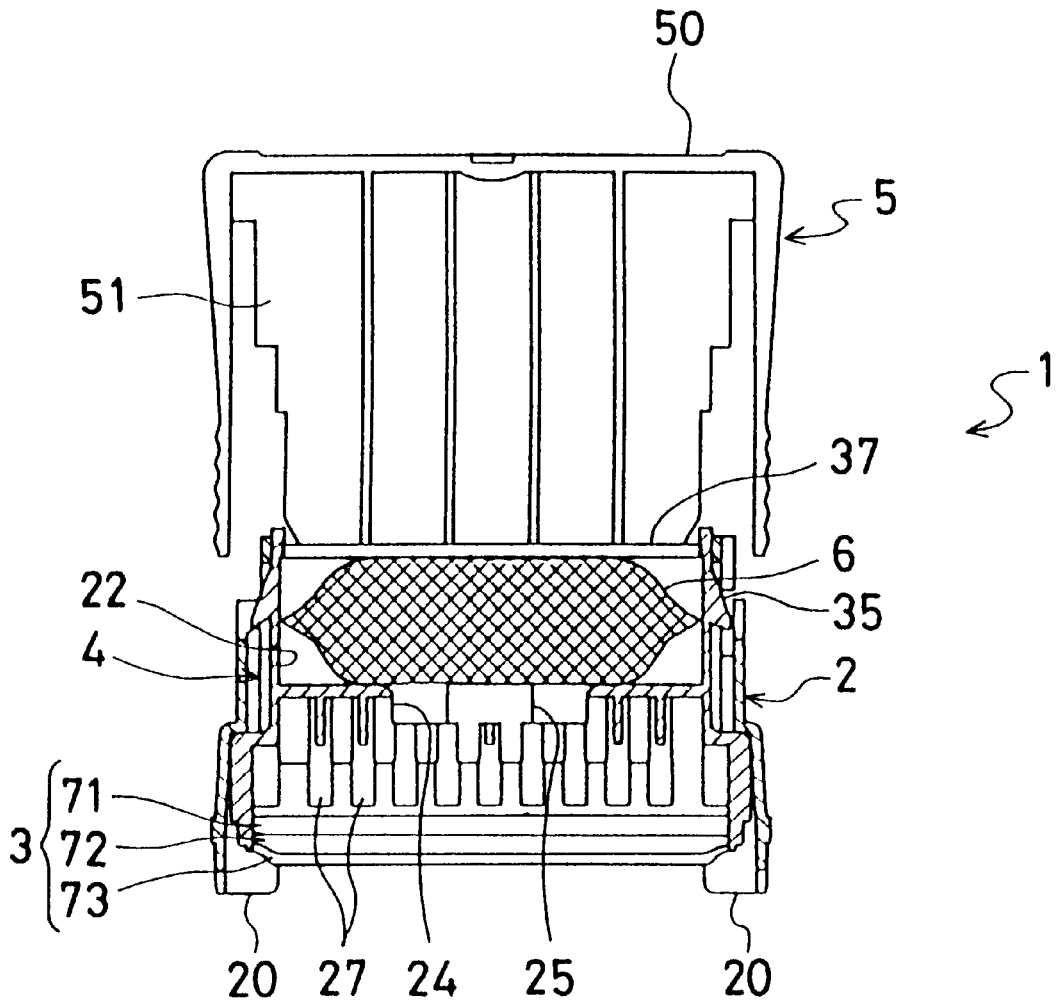
FIG. 10 is a sectional side elevation of the stamp unit of FIG. 9 before the ink pack is opened.

After the holder member 4 and the skirt member 2 are assembled as mentioned above, the inserting portion 51 of the grip member 5 is inserted into the circumferential side wall 32 of the holder member 4, as shown in FIG. 10. The ink pack 6 in the holder member 4 is sandwiched and pressed between the thick paper plate 37 and the cutting rib 25 when the grip member 5 is then pressed downwardly. The thick paper plate 37 spreads the downward force substantially uniformly across the surface of the ink pack 6. Therefore, the ink pack 6 is cut and opened at the portion contacting the cutting rib 25. Because the ink pack 6 is opened at substantially a center portion, according to the forming position of the cutting rib 25, ink flows from the ink pack 6 to be dispersed substantially uniformly around the cutting rib 25. Further, because the thick paper plate 37 is capable of absorbing ink, it absorbs ink that flows from the ink pack 6 to its upper side and prevents the ink from leaking from the stamp unit 1.

Further, the ink flows at once when the ink pack 6 is opened by the cutting rib 25. However, as the space formed between the side wall 32 and the cutting rib 25 is a storing portion for the ink flowing from the ink pack 6, ink leakage from the holder member 4 is prevented even though ink flows at once when the ink pack 6 is opened.

Figure 11:
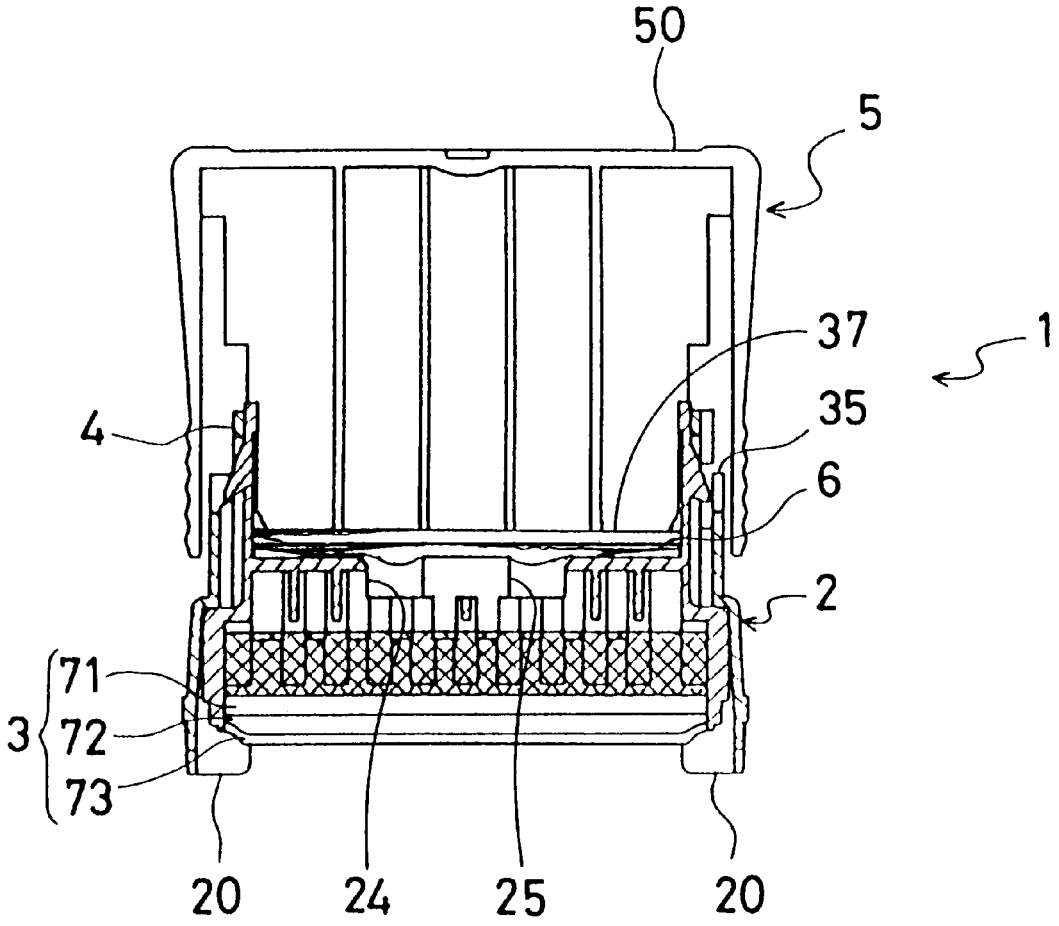
FIG. 11 is a sectional side elevation of the stamp unit of FIG. 9 immediately after the ink pack is opened.

Ink flowing from the ink pack 6 is guided downwardly by the ink flow hole 24 formed around the cutting rib 25 and pools on the stamp material 3 for a while (FIG. 11 shows this state). The ink then impregnates the stamp material 3 after several minutes. At this time, because the ink flow hole 24 is formed around the cutting rib 25 and the support rods 27 are provided downward of the ink flow hole 24, ink from the ink pack 6 is dispersed completely over the bottom portion of the holder member 4, and the ink uniformly impregnates the stamp material 3.

Further, when the ink pack 6 is opened by moving the grip member 5 downward, the protrusions formed by the rib engaging grooves 54, which are formed at the lower end of each rib 53 of the grip member 5, are fitted into corresponding grooves 33 formed on the circumferential side wall 32 of the holder member 4. Thus, the holder member 4 and the grip member 5 are connected. Therefore, if a user wants to perform stamp printing of the characters of the stamp plate formed on the stamp material 3 after ink impregnates the stamp material 3 as mentioned above, the grip member 5 and the holder member 4 move integrally, to perform the stamp printing.

Further, if the stamp printing cannot be performed at the proper density because ink impregnating the stamp material 3 runs out, stamp printing can be started again by removing the grip member 5 from the holder member 4, then removing the thick paper plate 37 and depleted bag-shaped ink pack 6 from the holder member 4, and setting a new ink pack 6 within the holder member 4. Then the operations described above are again performed for stamp printing. Further, the stamp printing can be started again by supplying ink through the ink supply holes 26 formed on the inner surface of the circumferential side wall 32 of the holder member 4 without removing the ink pack 6 and the thick paper plate 37.

As described above, for the supply of ink to the stamp material 3 of the stamp unit 1 of the embodiment, the grip member 5 is pressed downward toward the ink pack 6 provided in the holder member 4, the ink pack 6 is thereby sandwiched between the thick paper plate 37 and the cutting rib 25 and opened. Thereby, ink in the ink pack 6 flows downward through the ink flow hole 24 and is supplied to the stamp material 3. Thus, ink can be supplied to the stamp material 3 very easily in one step.

Further, if it is necessary to supply ink to the stamp material 3 because ink impregnated into the stamp material 3 runs short by repeated stamp printing, and the density of printing characters declines, the stamp printing can be resumed after supplying ink by the simple process of replacing the ink pack 6.

Further, as the cutting rib 25 contacting the ink pack 6 and the ink supply hole 24 for supplying ink into the stamp material 3 are provided, the ink pack 6 can be opened easily and quickly by the cutting rib 25, so that ink flows from the ink pack 6 to quickly impregnate the stamp material 3.

Ink flowing from the ink pack 6 is guided downwardly by the ink flow hole 24 formed around the cutting rib 25 and impregnates the stamp material 3. Because the ink flow hole 24 is formed around the cutting rib 25 and the support rods 27 are downwardly of the ink flow hole 24, ink from the ink pack 6 is uniformly dispersed over the bottom portion of the holder member 4, so that ink uniformly impregnates the stamp material 3.

Although a preferred embodiment of the invention has been described, it is not intended to limit the invention to the foregoing embodiment, and modifications and variations are possible without departing from the spirit of the invention.

For example, in the stamp unit 1 of the embodiment, although the stamp material 3 is comprised of three layers, such as two hard porous resin layers and one soft porous resin layer, the stamp material 3 may be comprised of two layers, such as one upper layer made of a hard porous resin layer and one lower layer made of a soft porous resin dispersed with light energy absorbing materials, such as carbon black, or the stamp material 3 may include four or more layers by providing three or more layers of the hard porous resin layers. Further, the shape or location of the ink supply hole(s) can be changed.

Further, in the embodiment, although the transparent films 91, 92 are made from one film folded in two, two transparent films adhered with a transparent adhesive agent can be used, or one film folded in two and adhered with a transparent adhesive agent can be used.

What is claimed is:

1. A stamp unit, comprising:

a skirt member;

a holder member slidably disposed within the skirt member for movement in an axial direction, the holder member holding a stamp material at a lower end portion thereof;

a grip member disposed above the holder member, the grip member moving the holder member downwardly; and a transparent film which covers a stamp surface of the stamp material, wherein an outer periphery of the stamp material is thermally adhered to a lower edge of the holder member, and the transparent film is thermally adhered to the lower edge of the holder member.

2. The stamp unit according to claim 1, wherein said holder member, the stamp material and the transparent film are made of resin materials, a melting temperature of a resin material included in the transparent film being higher than a melting temperature of a resin material included in the holder member and the stamp material.

3. The stamp unit according to claim 1, wherein the holder member, the stamp material and the transparent film are thermally adhered simultaneously by a thermal adhesion jig.

4. The stamp unit according to claim 1, wherein the transparent film is made of a transparent resin film.

5. The stamp unit according to claim 1, wherein a grip portion is formed on an outer periphery of a thermal adhesion portion of the transparent film, the grip portion is held at the time that the transparent film is peeled from the lower edge of the holder member.

6. The stamp unit according to claim 5, wherein the transparent film is held by the grip portion, and peeled from the lower edge of the holder member prior to stamp printing using the stamp material.

7. The stamp unit according to claim 1, wherein the stamp material comprises a porous resin layer including light energy absorbing materials.

8. The stamp unit according to claim 1, wherein the transparent film which covers the stamp material is coated with a releasing material on a surface facing to the stamp material and is thermally adhered with the outer periphery of the stamp material.

9. The stamp unit according to claim 8, wherein the releasing material is coated on both sides of the transparent film.

10. The stamp unit according to claim 8, wherein the releasing material is silicone resin.

11. The stamp unit according to claim 8, wherein the releasing material is fluorine resin.

12. The stamp unit according to claim 8, wherein the releasing material is coated on a surface of the transparent film facing to the thermal adhesive jig.

13. The stamp unit according to claim 1, wherein the transparent film comprises a first transparent film and a second transparent film.

14. The stamp unit according to claim 13, wherein the outer periphery of the stamp material is adhered with the first transparent film arranged to cover the stamp material, the second transparent film being provided on a side opposite to the side adhered to the stamp material, the second transparent film overlapping with the first transparent film, and not thermally adhered to the first transparent film.

15. The stamp unit according to claim 14, wherein the first transparent film and the second transparent film are provided by folding one transparent film in two.

16. The stamp unit according to claim 14, wherein the first transparent film and the second transparent film are adhered using a transparent adhesive agent.

17. A stamp plate for a stamp printing unit, comprising:

a holder member;

a stamp material mounted in the holder member; and a transparent film covering an exposed surface of the stamp material, the holder member and stamp material being adhered around opposing peripheral edges and the transparent film adhered to both the stamp material and the holder member at their peripheral edges.

18. The stamp plate according to claim 17, the transparent film having at least one portion extending outside the peripheral adherence to provide a gripping portion.

19. The stamp plate according to claim 17, wherein the adherence of the holder member stamp material and transparent film is thermal adherence, and the holder member, stamp material, and transparent film are different resins having different melting points with a melting point of each of the holding member and stamp material being less than a melting point of the transparent film.

20. The stamp plate according to claim 17, wherein the transparent film is folded to provide a double layer of film over the exposed surface of the stamp material, only a layer immediately adjacent the stamp material adhered to the peripheral edges of the stamp material and the holder member.

* * * * *